United States Patent [19]

Minami et al.

[11] Patent Number: 4,702,191

[45] Date of Patent: Oct. 27, 1987

[54] SAIL DEVICE

[75] Inventors: Hirokazu Minami; Nobuhiko Ishizu; Matsuo Ota, all of Osaka, Japan

[73] Assignee: Taiyo Kogyo Co., Ltd., Osaka, Japan

[21] Appl. No.: 853,260

[22] Filed: Apr. 17, 1986

[30] Foreign Application Priority Data

Jun. 27, 1985 [JP] Japan ..... 60-97816

[51] Int. Cl.[4] ..... B63H 9/00

[52] U.S. Cl. ..... 114/106; 114/102; 114/104; 114/107

[58] Field of Search ..... 114/102–109, 114/39

[56] References Cited

U.S. PATENT DOCUMENTS

| | | | |
|---|---|---|---|
| 3,706,296 | 12/1972 | Milde | 114/102 |
| 4,448,144 | 5/1984 | Selioo | 114/102 |
| 4,501,216 | 2/1985 | Voslamber | 114/102 |
| 4,546,718 | 10/1985 | Schwartz | 114/104 |

FOREIGN PATENT DOCUMENTS

| | | | |
|---|---|---|---|
| 3129225 | 5/1983 | Fed. Rep. of Germany | 114/106 |
| 157563 | 1/1979 | Netherlands | 114/106 |

*Primary Examiner*—Joseph F. Peters, Jr.

*Assistant Examiner*—Clifford T. Bartz

*Attorney, Agent, or Firm*—Armstrong, Nikaido, Marmelstein & Kubovcik

[57] ABSTRACT

A sail device characterized in that a sail frame is formed of upper and lower horizontal beam members fixed horizontally to a mast and linealy bent at bending points, holding pillars that are rotatably supported at the above mentioned bending points by these horizontal beam members and that hold a part of a developed sail, and supporting pillars arranged and fixed at both right and left ends of the above mentioned horizontal beam members and assembled rotatably with respect to the horizontal beam members and rotation stoppably by stopper means, at least, between the above mentioned upper and lower horizontal beam members, the lower horizontal beam member is formed to be of a horizontally expanding shape, a sail formed of a flexible material is reinforced by fitting a plurality of self-standing rods in the vertical direction of the sail and the above mentioned self-standing rods can be supported at the lower ends on the above mentioned lower horizontal beam member.

3 Claims, 5 Drawing Figures

SAIL DEVICE

BACKGROUND OF THE INVENTION (1) Field of the Invention:

This invention relates to sail devices and more particularly to a sail device adapted to small ships.

(2) Description of the Prior Art:

Various ships utilizing sails are recently suggested from the viewpoint of saving energy.

Now, sails are largely divided into soft sails and hard sails and either must be folded when the wind is too strong. As a method of folding the sail, for soft sails, there is taken a method wherein a sail is wound inside or outside a mast. On the other hand, for hard sail, there is a method wherein a hard sail is divided into many small sails which are slid along a frame (the gazettes of Japanese patents laid open Nos. 25644/1980 and 116593/1981) or a method wherein a hard sail is divided in the same manner into small sails which are rotated like window blinds (the gazette of Japanese patent laid open No. 47296/1982). However, either is considerably complicated in the structure.

Also, in order to improve the air force characteristic of sails, for examle, for soft sails, hard sails are combined with a soft sail at both ends and a yard is curved forward (the gazettes of Japanese patents laid open Nos. 58594/1982 and 63595/1981) and, on the other hand,.for hard sails, a hard sail itself is formed as curved to be of a predetermined curved surface. However, either is considerably costly for such information.

On the other hand, the convenience of using a sail and engine in common is recognized in such small ships as fishing boats. However, the sail of the above mentioned already suggested method or system can not be directly applied in view of the structure and cost. Therefore, the present inventors have repeated hard reserches to develop a sail well applicable even to small ships and, as a result, have obtained a conclusion that, though there has been formed a fixed conception that a sail itself must be formed as curved to be of a predetermined curved surface because the air force characteristic is considered too much in the conventional sail, in order to perform the role as of a sail, the sail need not always be of a curved surface but may be of a shape which can utilize the wind force in short.

SUMMARY OF THE INVENTION

The present invention is made on the basis of such actual situation and reserch results as in the above. The problems to be solved by the invention are that conventional sail is complicated in the structure and is too costly.

An object of the present invention is to provide a sail which is simple in the structure, is low in the cost, can be perfectly developed and can well perform the role of saving energy.

A more particular object of the present invention is to provide a sail which can be applied as it is even to small ships being already used.

The means taken by the present inventors to solve the above problems is as follows:

A sail device chracterized in that a sail frame is formed of upper and lower horizontal beam members fixed horizontally to a mast and linearly bent at bending points, holding pillars that are rotatably supported at the above mentioned bending points by these horizontal beam members and that hold a part of a developed sail, and supporting pillars arranged and fixed at both right and left ends of the above mentioned horizontal beam members assembled rotatably with respect to the horizontal beam members and rotation stoppably by stopper means, at least, between the above mentioned upper and lower horizontal beam members, the lower horizontal beam member is formed to be of a horizontally expanding shape, a sail formed of a flexible material is reinforced by fitting a plurality of self-standing rods in the vertical direction of the sail and the above mentioned self-standing rods can be supported at the lower ends on the above mentioned lower horizontal beam member.

DETAIL DESCRIPTION OF THE PREFERRED EMBODIMENT

Figure 1:
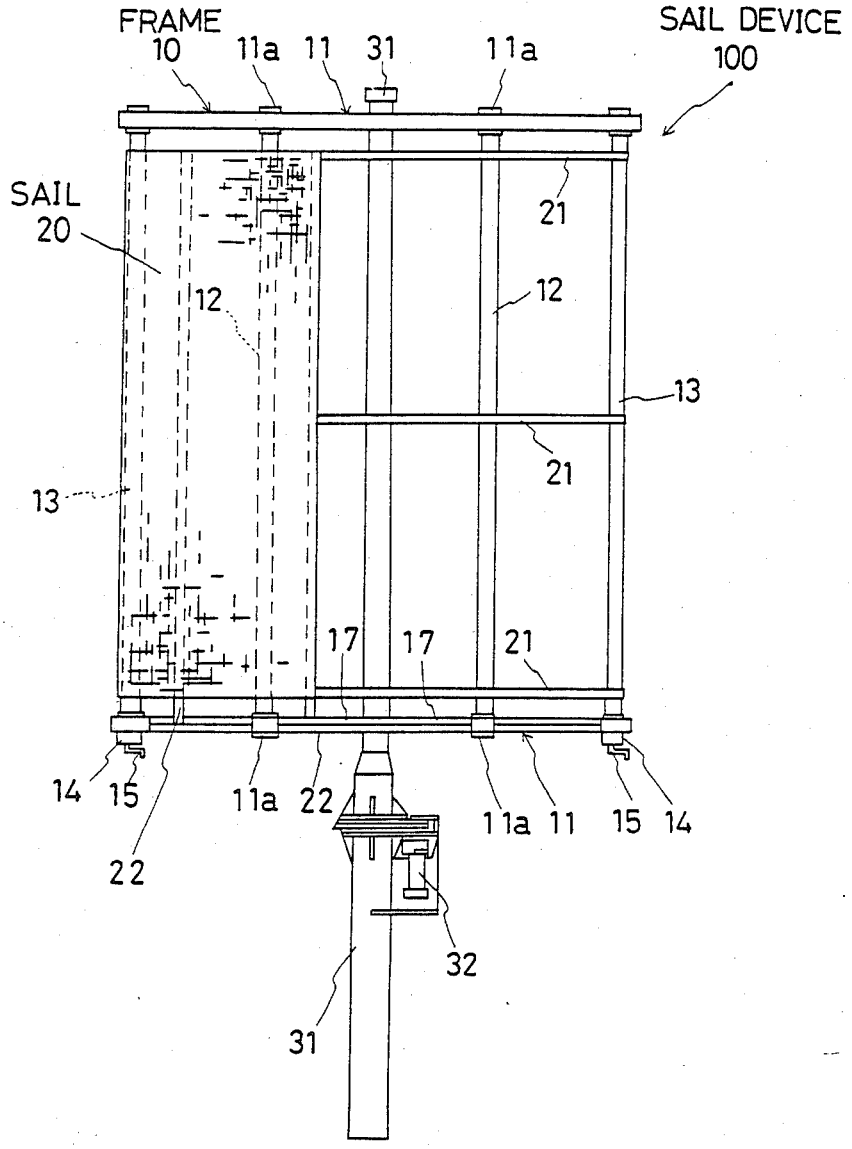
FIG. 1 is an elevation of a sail device according to the present invention.

This means shall be explained in the following on the basis of an embodiment shown in the drawing:

FIG. 1 shows an elevation of a sail device 100 according to the present invention. This sail device 100 consists of a frame 10 fixed to the upper side of a mast 31 and a sail 20 fitted to this frame 10 and is to be fitted to the mast 31 of a ship. The mast 31 of this ship 30 is divided into two upper lower sides and the upper side of the mast 31 can be rotated by a proper angle by a rotating device 32 provided on the lower side of this mast 31. This sail device 100 can be arranged in the position most efficient for the direction of wind by properly rotataing the upper side of the mast 31. By the way, this sail device 100 may be rotated by a remote control within a steering room or with the rotating device directly by the operator.

The frame 10 consists mostly of horizontal beam members 11, holding pillars 12 and supporting pillars 13. These horizontal beam members 11, hold-pillars 12 and supporting pillars 13 are respectively in pairs.

Figure 2:
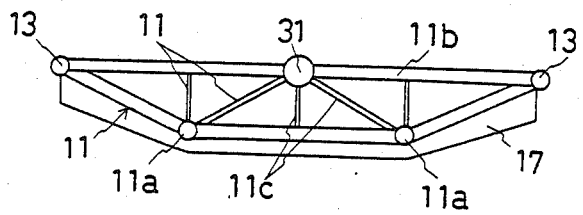
FIG. 2 is a plan view of the same.
Figure 3:
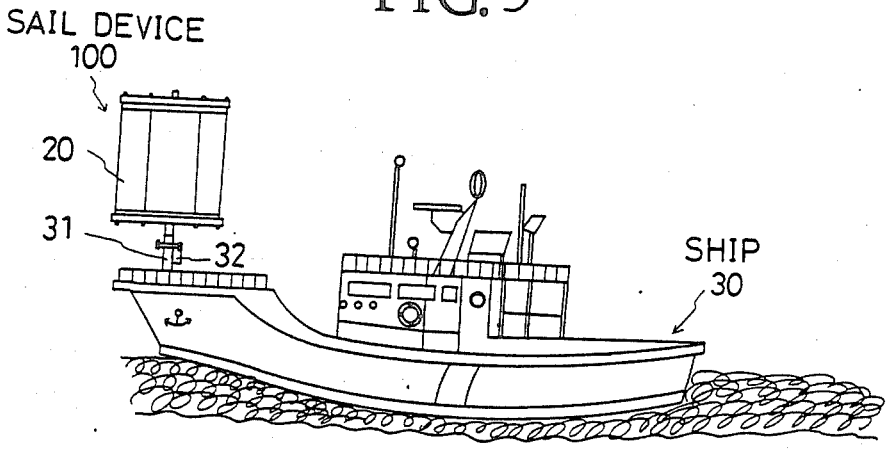
FIG. 3 is a perspective view of the present sail device as applied to a ship.

As shown in FIG. 2 each horizontal beam member 11 is bent at two bending points 11a along it and is otherwise linear. At least, between these upper and lower horizontal beam members 11, the lower horizontal beam member 11 is formed to be of a shape expanding horizontally so that later described self-standing rods 22 can be supported on its upper surface 17.

On the other hand, the upper and lower horizontal beam members 11 of this embodiment are formed by cutting comercial bar members or pipe members to be of proper lengths and connecting them with one another by proper means and the connecting parts are made the bending points **11*a*. Also, as shown in FIG. 2, these horizontal beam members 11 are fixed horizontally to the mast 31 by supporting rods 11*b* and connecting rods 11*c* secured to the upper part of the mast 31 so as to be held in a predetermined position with respect to the mast 31**.

Figure 4:
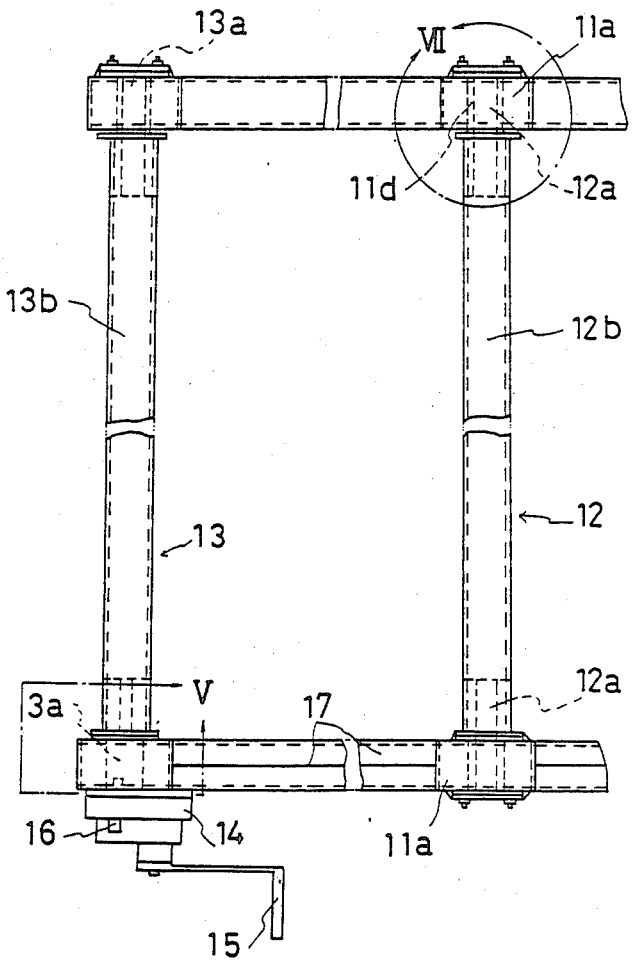
FIG. 4 is a magnified elevation of an essential part of FIG. 1.
Figure 5:
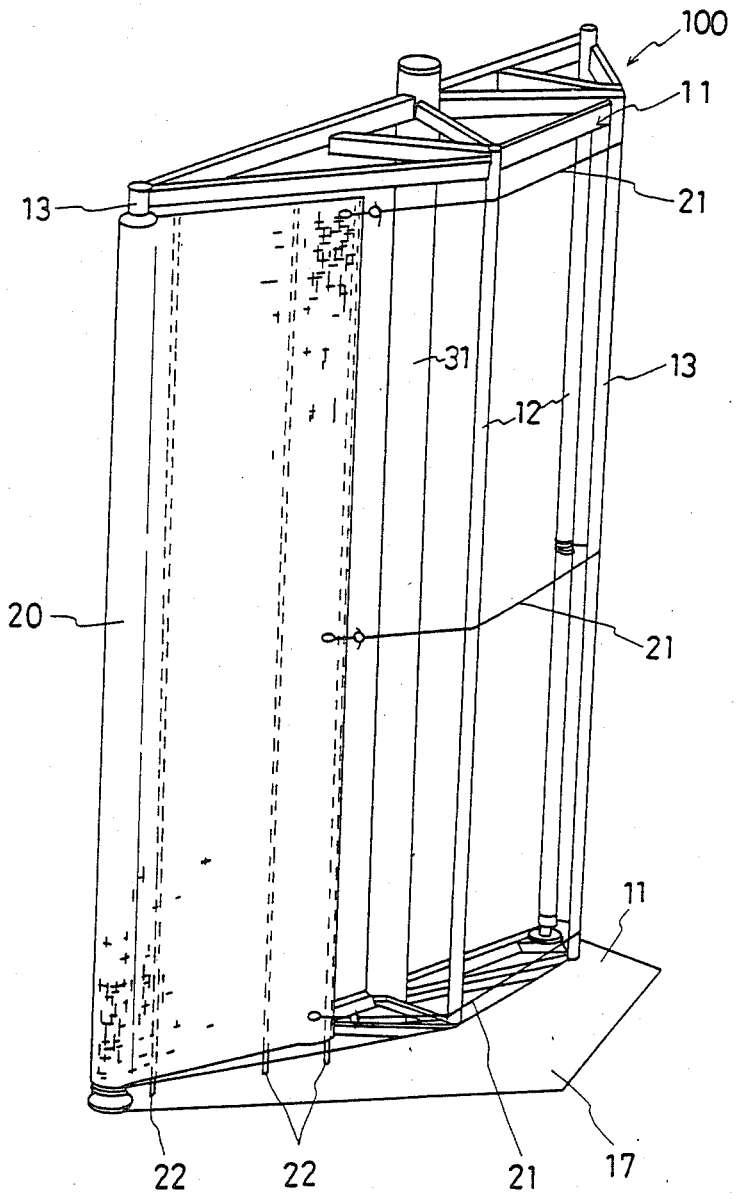
FIG. 5 is a perspective view of the sail device while being developed and stretched.

As shown in FIG. 4, a supporting shaft 12*a* of each holding pillar 12 is secured within a sleeve 11*d* fitted to the bending point 11*a* part of each horizontal beam member 11 and each holding pillar 12 is supported rotatably with respect to this supporting shaft 12*a* but may be fitted directly to each horizontal beam member 11.

Each supporting pillar 13 is fundamentally of the same formation as of each holding pillar 12 mentioned above and consists of a supporting shaft 13*a* provided at each end of each horizontal beam member 11 and a sleeve 13*b* supported as spline-fitted to this supporting shaft 13*a*, rotating integrally with the supporting shaft 13*a* and connected to the supporting pillar 13. A gear box 14 arranged on the lower horizontal beam member 11 is connected to each supporting shaft 13*a* positioned on the lower side of each supporting pillar 13.

This gear box 14 has its output shaft connected to the supporting shaft 13*a* of the supporting pillar 13 so that, when the user rotates its handle 15, the supporting shaft 13*a* will be rotated and thereby the sleeve 13*b* will be rotated. Also, this gear box 14 is provided with a gear stopping pawl 16 which is a stopper means so that, when the gear stopping pawl 16 is operated, the rotation of the gears within the gear box 14 will be stopped and thereby the rotation of the supporting shaft 13*a* of the supporting pillar 13, that is, the sleeve 13*b* will be prevented.

A sail 20 is formed of a flexible cloth or the like, is secured on one end edge in the vertical direction to either of the above mentioned sleeves 13*b* and has a plurality of winding members 21 connected to the other end edge. Each winding member 21 is connected to the free end to the other sleeve 13*b*.

Further, this sail 20 is fitted with a plurality of self-standing rods 22 in the vertical direction. Various ways of fitting these self-standing rods 22 to the sail 20 are available. However, in this embodiment, they are fitted by stitching separate cloths formed of the same material to the sail 20. By the way, the self-standing rods 22 may be fitted to the sail 20 by being stitched with tough threads or the like. the self-standing rods 22 are made slightly longer than the vertical length of the sail 20 so as to be able to contact at the lower ends with the upper surface 17 of the lower horizontal beam member 11.

The operation of the sail device 100 formed as in the above shall be explained in the following:

First of all, the sail device 100 is manufactured in a factory, is transported to a port where a ship is staying and is fitted to the ship. In such case, in the ship, the mast 31 may be provided on the deck or the like in advance.

In case the fitted sail device 100 is not used, the sail 20 will be wound up on one supporting pillar 13 side and will be so-called folded. That is to say, the frame 10 will be able to well pass wind and respective winding members 21 connected to the other supporting pillar 13 will be perfectly extended. The gear stopping pawls 16 of the respective gear boxes 14 will be locked to stop the rotation of the gears.

In case the sail device 100 is to be developed and stretched from such state, the gear stopping pawls 16 of both gear boxes 14 are unlocked. Then the handle 15 of the gear box 14 on the side on which the winding members 21 are fitted is rotated to wind up the respective winding members 21 on the supporting pillar 13 so that the sail 20 will be unwound, developed and stretched in turn from the supporting pillar 13. In such case, the sail 20 which is reinforced by the respective self-standing rods 22 will never loosen when it is developed and stretched. Also, as the respective self-standing rods 22 are in contact at the lower ends with the upper surface 17 of the lower horizontal beam member 11, the sail 20 will be positively guided in the developing and stretching direction without being displaced in the vertical direction.

When the sail 20 is perfectly developed and stretched as in the above, the gear stopping pawls 16 of the respective gear boxes 14 are locked with a predetermined tension given to the sail 20 so that the sail will be fixed as developed and stretched. At this time, the holding pillars 12 will guide th winding members 21 and sail 20 so that the sail 20 will be smoothly developed and stretched.

When the sail is thus developed and stretched, even though the sail 20 is linear between the holding pillar 12 and supporting pillar 13 and beatween both holding pillar 12, as the respective horizontal beam members 11 are bent in the bending point 11a parts and are held by the respective holding pillars 12 sucured to those parts, such surfaces as will produce a predetermined air force characteristic will be formed. Further, as this sail 20 is supported on both right and left edges with a predetermined tension given, even if it is not supported on the upper and lower end edges, the sail will be kept perfectly developed and stretched.

Further, in this sail device 100, as at least the lower horizontal beam member 11 of the upper and lower horizontal beam members 11 is formed to be of a horizontally expanding shape, the turbulence of air in the lower end part of the sail 20 will be regulated and the sail 20 will be prevented from being subjected to any unnecessary force.

On the other hand, in case the ship provided with this sail device 100 is under a strong wind and the sail is to be folded, an operation reverse to that described above may be made.

Further, in this sail device 100, even though linear members are used for all the respective members forming the frame 10, the wind force will be able to be well utilized, because, in order to obtain a sufficient air force obtain a sufficient air force characteristic, the plane shape of the sail 20 need never be made such curved surface as of the cross-section of the wing of an aircraft but may be sufficient to receive wind in view of the conclusion obtained by the experiments made by the present inventors. Therefore, as the frame 10 can be formed of linear materials, this sail device 100 can be easily manufactured as having a required air force characteristic.

As explained above, not only, when the sail device 100 according to the present invention is used, the small ship will be able to be well helped to navigate but also, as the sail device 100 can be formed by using linear members, it can be very easily manufactured. Therefore, the sail device can reduce the production cost and can be well applied to such small ships as fishing boats requiring this kind of sail device 100.

Further, in the sail device 100 of the present invention, as the sail 20 formed of a frexible material is reinforced by a plurality of self-standing rods 22 in the vertical direction, the sail 20 can be perfectly developed and stretched and folded. As the self-standing rods 22 are moved while in contact at the lower ends with the upper surface 17 of the horizontal beam member 11, the effects can be more positive.

Further, this sail device 100 is so simple in the formation that only the sail device 100 may be manufactured in a factory, transported to a port in which a ship is staying and fitted to the ship there. It can be well applied even to a ship already used.

We claim:

1. A sail device comprising:

a vertical beam mast;

a pair of upper and lower first horizontal beam members fixed at said mast with a certain interval therebetween, said first horizontal beam members being substantially straight;

a pair of upper and lower second horizontal beam members each fixed to each first horizontal beam member at both ends thereof, each second horizontal beam member being composed of a plurality of straight beams in a manner such that said first upper and lower horizontal beam members and said second upper and lower horizontal beam members form substantially a pair of opposing upper and lower trapezoid shape beam structures;

a pair of supporting pillars rotatably fixed between both ends of said upper and lower horizontal beam members and perpendicularly thereto, each pillar being provided with a gear box;

a plurality of vertical holding pillars provided between said upper and lower second horizontal beam members; and a sail reeled and pulled up around one of said supporting pillars at one end of the sail thereof and having a winding member at another end of the sail thereof, said winding member being reeled and pulled up by the other supporting pillar, wherein said sail and winding member can be extended over the outside of said plurality of vertical holding pillars.

2. A sail device according to claim 1, wherein said plurality of vertical holding pillars are rotatably supported between said upper and lower second horizontal beam members.

3. A sail device according to claim 1, wherein all the sides of the sail device are straight except said sail and winding member.

* * * * *